US006354954B1

(12) United States Patent
Sumner

(10) Patent No.: US 6,354,954 B1
(45) Date of Patent: Mar. 12, 2002

(54) AMUSEMENT APPARATUS AND METHOD

(75) Inventor: Mark W. Sumner, Valencia, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 09/750,463

(22) Filed: Dec. 28, 2000

(51) Int. Cl.[7] ..... A63G 31/16; A63J 5/02
(52) U.S. Cl. ..... 472/59; 472/60; 472/45
(58) Field of Search ..... 472/59, 60, 61, 472/75, 81, 130, 131, 39, 45; 434/29, 33, 34, 35, 55; 104/53, 58, 89, 91

(56) References Cited

U.S. PATENT DOCUMENTS

| | | | | |
|---|---|---|---|---|
| 2,076,113 A | | 4/1937 | Bartlett | 272/49 |
| 2,590,934 A | * | 4/1952 | Catlett | 472/3 |
| 3,628,829 A | | 12/1971 | Hellig | 47/12 |
| 3,707,282 A | | 12/1972 | Robinson | 63/8 |
| 3,868,107 A | | 2/1975 | Ichida | 63/16 |
| 4,642,945 A | | 2/1987 | Browning et al. | 52/10 |
| 4,879,849 A | | 11/1989 | Hollingsworth, III et al. | 52/10 |
| 4,976,438 A | | 12/1990 | Tashiro et al. | 273/313 |
| 5,192,247 A | | 3/1993 | Barr et al. | 472/60 |
| 5,433,670 A | | 7/1995 | Trumbull | 472/60 |
| 5,453,011 A | | 9/1995 | Feuer et al. | 434/38 |
| 5,611,174 A | | 3/1997 | Hayashi | 52/8 |
| 5,791,903 A | | 8/1998 | Feuer et al. | 434/38 |
| 5,803,816 A | | 9/1998 | Moser et al. | 472/46 |
| 5,845,434 A | | 12/1998 | Hayashi | 52/9 |
| 5,947,828 A | | 9/1999 | Fabbri | 472/30 |
| 6,053,576 A | | 4/2000 | Jessee | 297/344.19 |

* cited by examiner

*Primary Examiner*—Kien T. Nguyen
(74) *Attorney, Agent, or Firm*—Christie, Parker & Hale, LLP

(57) ABSTRACT

A motion simulator including passenger carrying apparatus designed to receive and carry a number of seated passengers from a first position in which the passengers board the apparatus into a second position from which the passengers view visual images displayed on a presentation screen. The apparatus includes multiple passenger carriers, each carrier including multiple rows of passenger seats, arrayed with a single presentation screen. Operation of the apparatus is such that the passenger seats are pivoted upwardly into a position directly above a portion of the presentation screen. A wing-shaped deployable canopy is provided over each passenger seat. In the deployed position, the canopy is positioned to block a portion of the passenger's visual field outside the presentation screen. Apparatus is provided for moving air and scent materials over the passengers to enhance the sense of flight created in the minds of the passengers. The motion simulator is suitable for use in an amusement park or theme park as an amusement ride.

17 Claims, 5 Drawing Sheets

AMUSEMENT APPARATUS AND METHOD

BACKGROUND OF THE INVENTION

The invention relates generally to the fields of mechanical and visual motion simulation. More particularly, the invention resides in a motion simulator that, in the preferred embodiment, is incorporated into an amusement park ride for a plurality of passengers. The ride provides, through a combination of motion and projected visual images, a convincing sensation of physical motion including flight over a panoramic area. This provides a highly immersive experience that is satisfying and enjoyable to the passengers.

Flight motion simulators have previously been used in fields including aircraft pilot training and amusement rides. Known motion simulators frequently combine applied motion with visual images projected onto some type of display screen. When the images are linked properly with the applied motion, these simulators can provide a convincing illusion of actual flight or motion over a wide area.

Many known motion simulators are less than ideal, however, because the moving images are displayed over only a relatively small area comprising only a fraction of the viewer's entire visual field. Outside the limited projection area, the view can see stationary objects, which is inconsistent with the illusion of motion the simulator is intended to create. This drastically limits the sense of immersion experienced by the viewer. It would be desirable, therefore, to devise a motion simulator in which moving images are presented to a viewer over a wide area comprising a significant portion of the viewer's visual field. It would be further desirable to provide a motion simulator in which areas of the viewer's visual field in which moving images are not projected are blocked from the viewer's vision by portions of the apparatus, thereby blocking nearby stationary objects from the view of the user.

In some known motion simulators, including applications used both for flight training and for entertainment, for example, the user enters into a closed chamber to block the user's vision outside the projection area of moving images. The user may sit as a passenger inside the closed chamber. The entire chamber is then moved as moving images, coordinated with the motion of the chamber, are projected into the visual field of the user. Such simulators provide a highly immersive experience and have been found very useful, e.g., for flight training.

Such closed-chamber simulators can be less than ideal, however, in entertainment applications, and in particular for uses such as amusement parks, where it is desirable to move a relatively large number of customers through the simulator quickly, conveniently, and safely. It is often inconvenient, time-consuming, at times even somewhat dangerous to load and unload passengers from motion simulators that incorporate full enclosures for the passengers. It would be desirable, therefore, to provide a motion simulator that would provide a highly immersive experience like the closed-chamber type, but that would be amenable to the rapid and convenient loading and unloading of large numbers of passengers so that the motion simulator could be incorporated profitably into a high volume entertainment ride such as might be found in an amusement park or a similar entertainment venue.

SUMMARY OF THE INVENTION

The invention resides in an amusement apparatus suitable for use as an amusement ride in an amusement or theme park. In a preferred embodiment, multiple seats serve as passenger stations and are attached to hangars, which are pivoted from a first position suitable for loading and loading the passengers, to a second position where the passengers are suspended over and in front of a video, cinema, or other presentation screen adapted for the display of visual images to the passengers.

In the preferred embodiment, a carriage is driven along a rail by a drive apparatus. The carriage is attached at one point to a hangar for the passenger station seats. The hangar is attached at another end to a pivot bar or another type of pivot member, which is attached in turn to a pivot point that is fixed in space with respect to the rail. As the carriage moves along the rail, the hangar and the seats are pivoted between the first and second positions.

The preferred embodiment further includes deployable canopies positioned over the heads of the passengers. When deployed the canopies block portions of the passengers' visual fields away from the presentation screen, thereby isolating the passengers somewhat from views away from the presentation screen. This enhances the immersion and sense of artificial flight experienced by the passengers.

The experience of the passengers may be further enhanced by the use of fans in the canopies operable to move air over the passengers as they watch the visual images. Optionally, nozzles may be provided to direct scent materials into proximity to the fans so that appropriate scents may be directed to the passenger in conjunction with selected visual images.

In some alternate embodiments, a retracting floor moves between a first position suitable for loading and unloading passengers into the seats, and a second position away from the passenger seats so that the passengers' feet are suspended some distance over the floor so that the seats may be lifted and moved safely into position over and in front of the presentation screen. In other embodiments, including in fact the embodiment presently preferred by the inventor, no retracting floor is necessary and so none is used.

BRIEF DESCRIPTION OF THE DRAWINGS

A preferred embodiment of the invention will be described below in connection with the accompanying drawings, in which.

DESCRIPTION OF THE PREFERRED EMBODIMENTS

Figure 5:
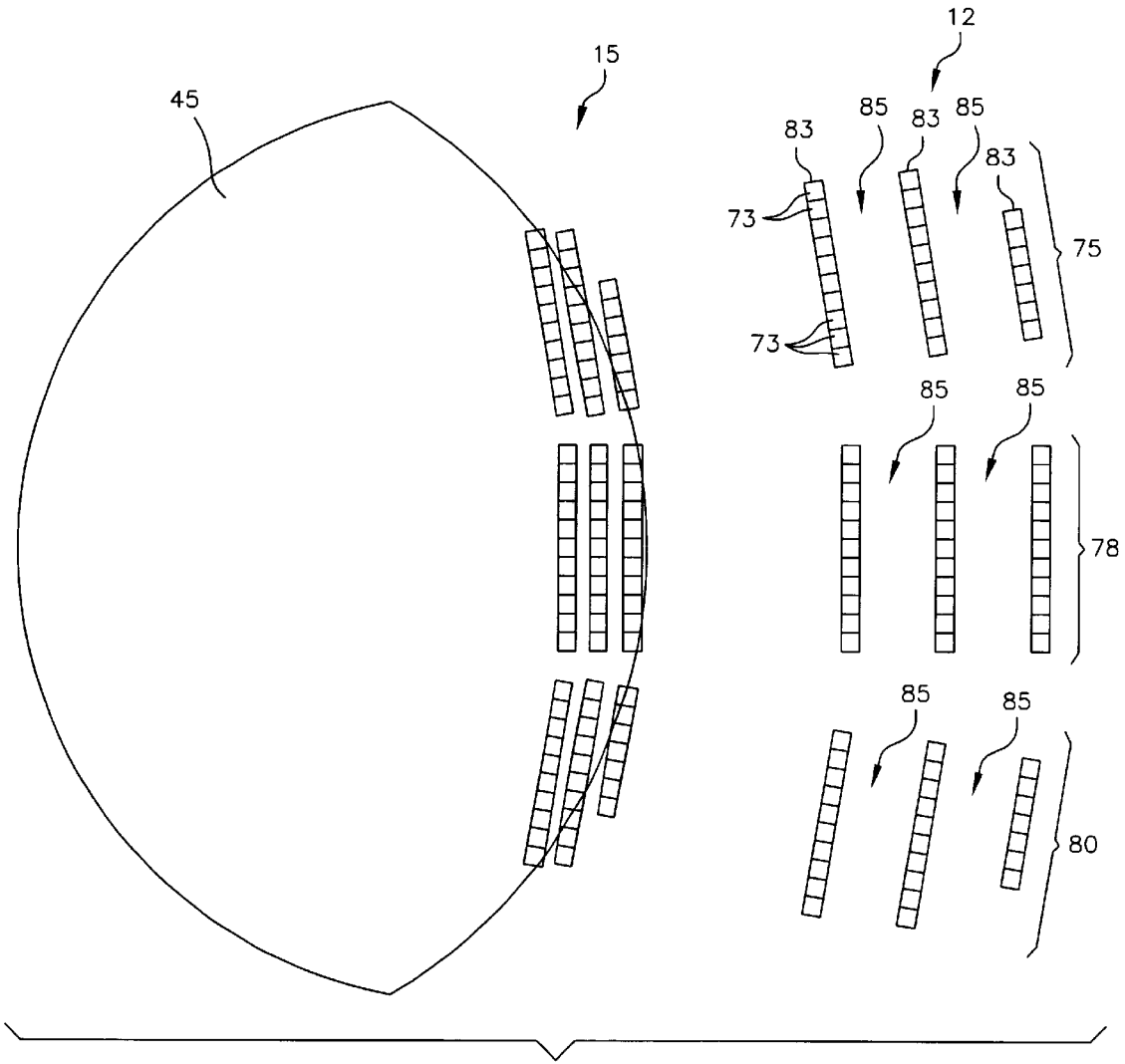
FIG. 5 is a schematic plan view indicating the arrangement of apparatus and passenger seats in a preferred embodiment of the invention.

The invention is embodied in an amusement apparatus for use as an entertainment ride in an amusement park. The amusement apparatus includes a plurality of seats for passengers, and a display screen for projecting images visible to the passengers from their seated positions. The seats are built into a number of seating assemblies arrayed alongside one another in front of the display screen (FIG. 5).

Figure 1:
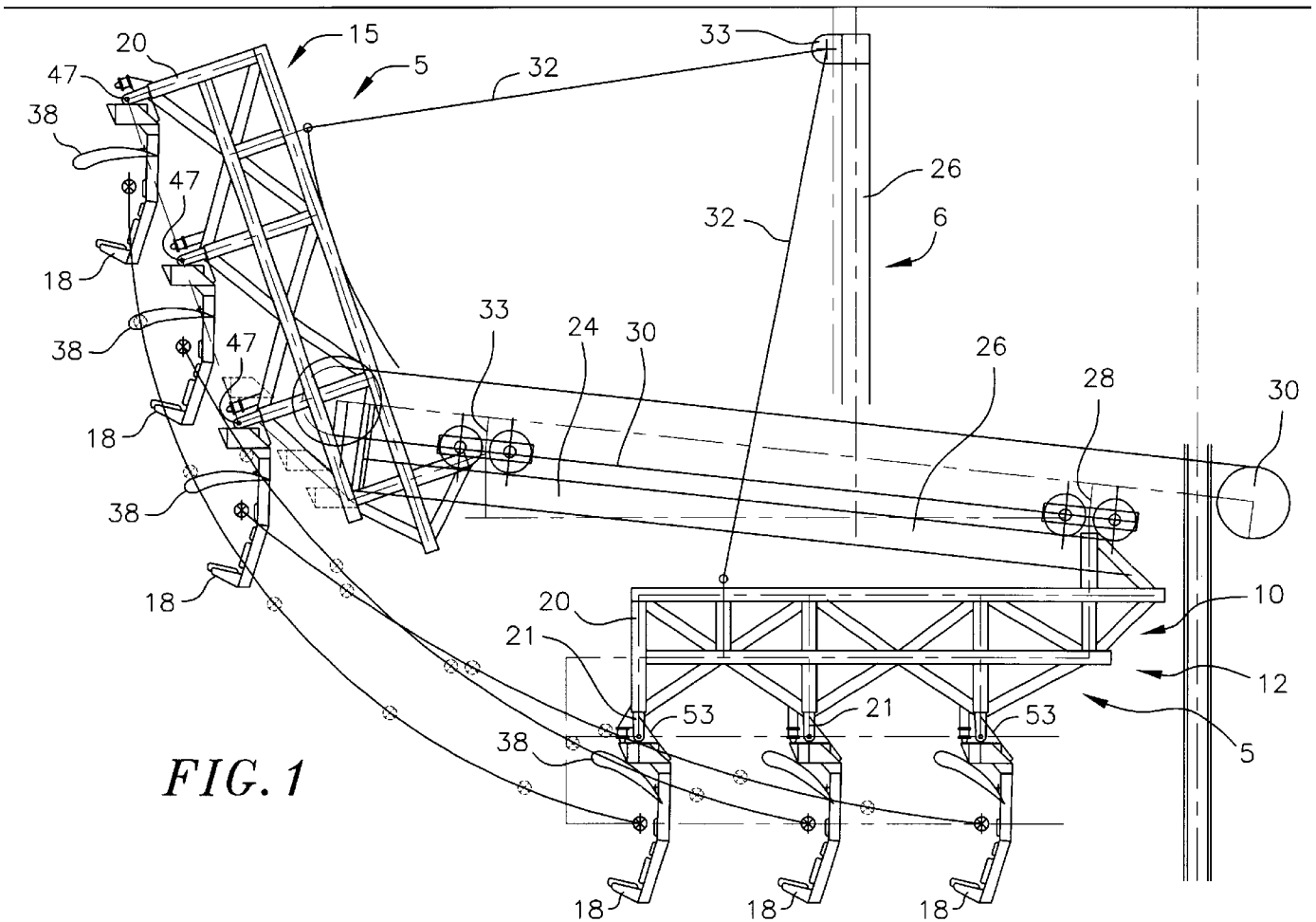
FIG. 1 is a side view depicting a passenger carrying apparatus that forms a portion of a preferred embodiment of the invention.

FIG. 1 is a side view of a single seating assembly 5 that forms a part of the preferred embodiment of the invention. The seating assembly is connected, as will be described, to a rigid, three-dimensional stationary supporting structure, indicated generally as 6, mounted in the ground extending upwardly in longitudinally and transverse directions. FIG. 1 shows the single seating assembly both in a lowered position 12 and a raised position 15.

The seating assembly 5 comprises a plurality of passenger seats 18. The seats are hung in rows at from a seat hanger frame 20 which comprises a longitudinally-extending, three-dimensional, open framework of connected beams. The frame includes longitudinally-spaced, laterally-extending rows of seat suspenders 21 which each support the seats 18 for pivoting motion in the vertical plane. The seat hanger 20 is supported below a longitudinally-extending rigid guide structure 24 connected to the support structure 6. The guide structure 20 has a guide rail 26 in which is mounted a wheeled carriage 28 that has a pivoted connection to the seat hanger frame adjacent its rear end. A reversible, electric drive motor 30, mounted to structure 24 is connected by a cable and pully drive system to drive the carriage between a rear, passenger loading position shown as 12 in FIG. 1 and a forward, viewing position, shown as 15 in FIG. 1. During the travel from the rear position to the forward position, the orientation of the seat hanger frame changes from generally horizontal to approaching vertical (FIG. 15).

A rigid tether 32, connected by a pivot point 33 to the support structure 6 and by another pivot point to the forward end of the hanger support 20, causes the hanger support to pivot upwardly about the carriage 28 as it moves from its generally horizontal loading position to its almost vertical viewing position.

It will be appreciated that, in the arrangement described, the combined effect of the guide rail, the carriage, and the tether, in changing the orientation of the hanger support, are analogous to the function achieved by a cam and cam follower arrangement. Thus, conventional cam and cam follower arrangements which could define a comparable path for the hanger support may be used in place of that described.

The foregoing arrangement spaces the seats 18 far apart horizontally above a boarding surface 42 forming part of the structure 6 to facilitate rapid boarding and deboarding of passengers in the lowered position. Each seat includes a retractable canopy 38, which deploys into position above each passenger's head as the seating assembly moves into the raised position. The purpose and operation of the canopies will be described below.

Alternative embodiments are possible in which a flexible member such as a flexible cable is used as a pivot member as the tether 32 in place of a rigid bar. This alternative is possible so long as the geometry of the apparatus is such that the flexible pivot member is constantly under some degree of tension.

The preferred embodiment, as described, uses a drive assembly based on a reversible, selectively operable electric motor mounted to the rear end of the guard rail and connected by conventional cable and pulling arrangements to the carriage. However, a wide variety of drive mechanisms may be substituted that could serve to move the seat assembly between the viewing and boarding positions, e.g., a motorized lead screw and drive nut connection, a hydraulic drive piston and rod, a scissors parallelogram drive system, a pneumatic drive system and other such interchangeable expedients for a motorized pully and cable drive. Designers of amusement park rides are skilled in the engineering and construction of such mechanisms.

Figure 2:
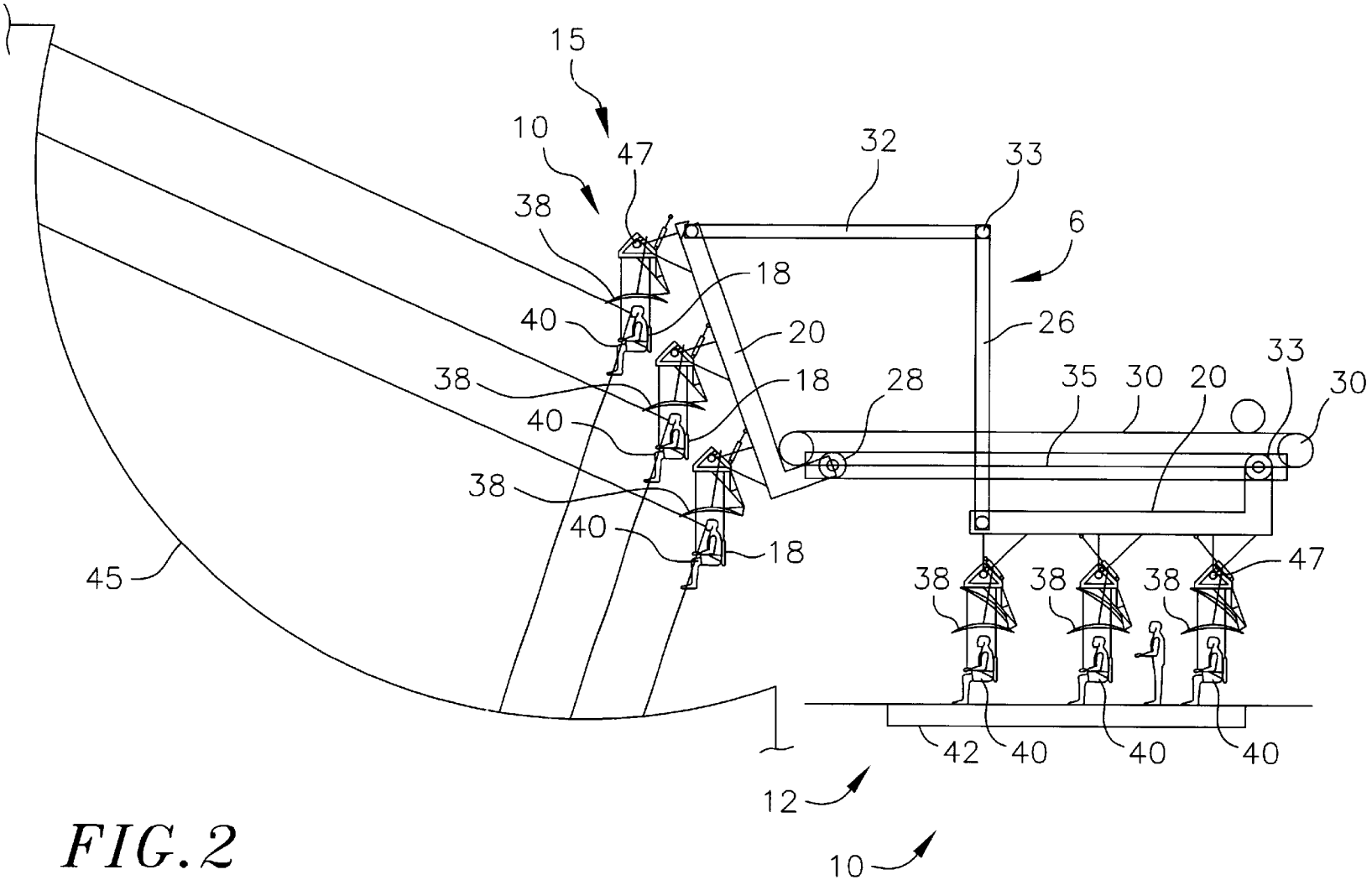
FIG. 2 is a side view depicting the apparatus of FIG. 1 in conjunction with a presentation screen used in a preferred embodiment of the invention.

FIG. 2 is another side view of a single seating assembly 10 of another embodiment of the invention in which the guide rail 35 is horizontal rather than at an inclination to horizontal. This figure further includes representations of a number of passengers 40 boarding and seated in the flight simulator, as would also occur in the preferred embodiment already described. As FIGS. 1 and 2 indicate, the seats 18 are spaced relatively far apart horizontally when the seating assembly is in the boarding position 12. This facilitates rapid loading and unloading of the passengers onto the ride.

In embodiments that include a retracting floor 42, the retracting floor drops away a short distance to leave the passengers seated in their seats 18 with their feet suspended in the air. In either case, after the passengers 40 are seated, the drive assembly is activated to pull the seating assembly carrying the seated passengers into the raised position 15.

In all embodiments, as the seats are raised, the retractable canopies 38 deploy into position over the passengers' heads. In the raised position, the passengers are seated relatively close to one another horizontally, with visibility enhanced by a substantial vertical separation between adjacent rows of seats.

Referring now particularly to FIG. 2, the passengers 40 are disposed in the raised position 15 in front of and directly over a curved presentation screen 45. The presentation screen is connected to and supported by the general supporting structure extending vertically and transversely and is curved arcuately in the vertical plane, for an embodiment having at least a single row of seats. In an embodiment having multiple, transversely spaced rows of seats spaced along a circular periphery, as shown in FIG. 5, the screen 45 also curves in the transverse plane. As the figure shows, the passengers' sight lines to the screen are blocked from below by the forward edge of the seats 18, and by the passengers' own knees and feet. From above, the passengers' sight lines are blocked by the forward edge of the retractable canopies 38 in their deployed positions. This serves to constrain the passengers' visual fields to the upper and lower limits of the presentation screen.

The presentation screen 45 may be any means—conventional, novel, or one yet to be developed—for presenting visual images to the seated passengers 40. In the presently preferred embodiment, the presentation screen is adapted for use with an image projector using high definition cinema projection equipment to present very high quality motion pictures to the passengers.

Figure 3:
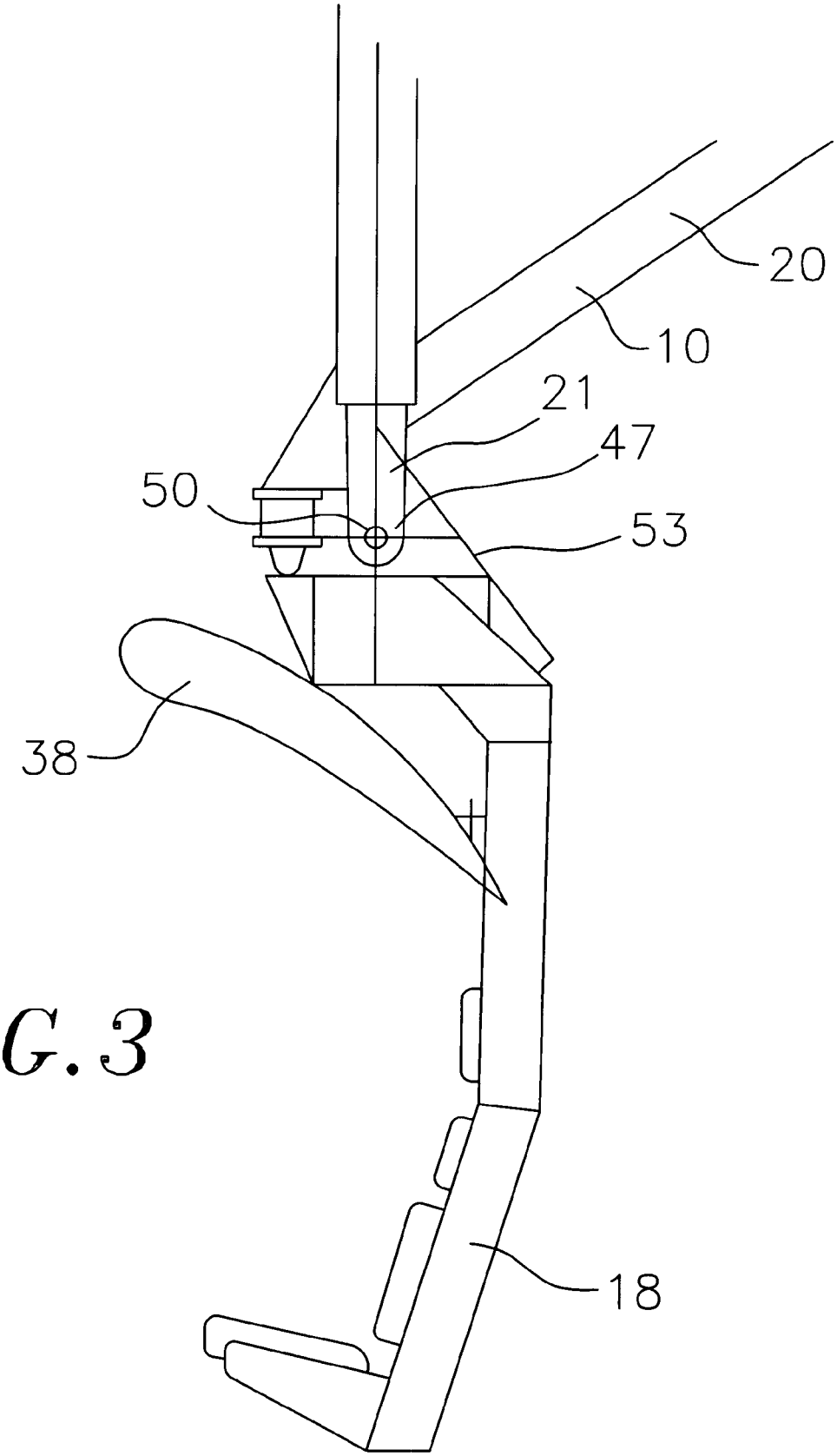
FIG. 3 is a side view of a passenger seat used in a preferred embodiment of the invention.

FIG. 3 shows a single seat 18 mounted on its seat hanger 20. The seat is mounted to associated one of the seat hanger suspending 21 at pivot point 47 for pivoting motion about a horizontal, transverse axis. A seat driver 50 is selectively operable to drive the seat in motion about the pivot point, thereby adjusting the pitch of the seat. In the preferred embodiment, the seat driver is a bellcrank-type cam driven by a reversible electric motor that applies a pitching force to the seat, but other seat drivers may be used in addition to or in place of the preferred one. A motion damper 53 between the seat and the seat hanger mount operates to control excessive swinging, whether from the seat driver, or from motion of the passenger in the seat. Although not depicted in the figures, each seat should be provided with a seat belt or another suitable passenger restraint to secure the passengers safely in their seats.

Figure 4:
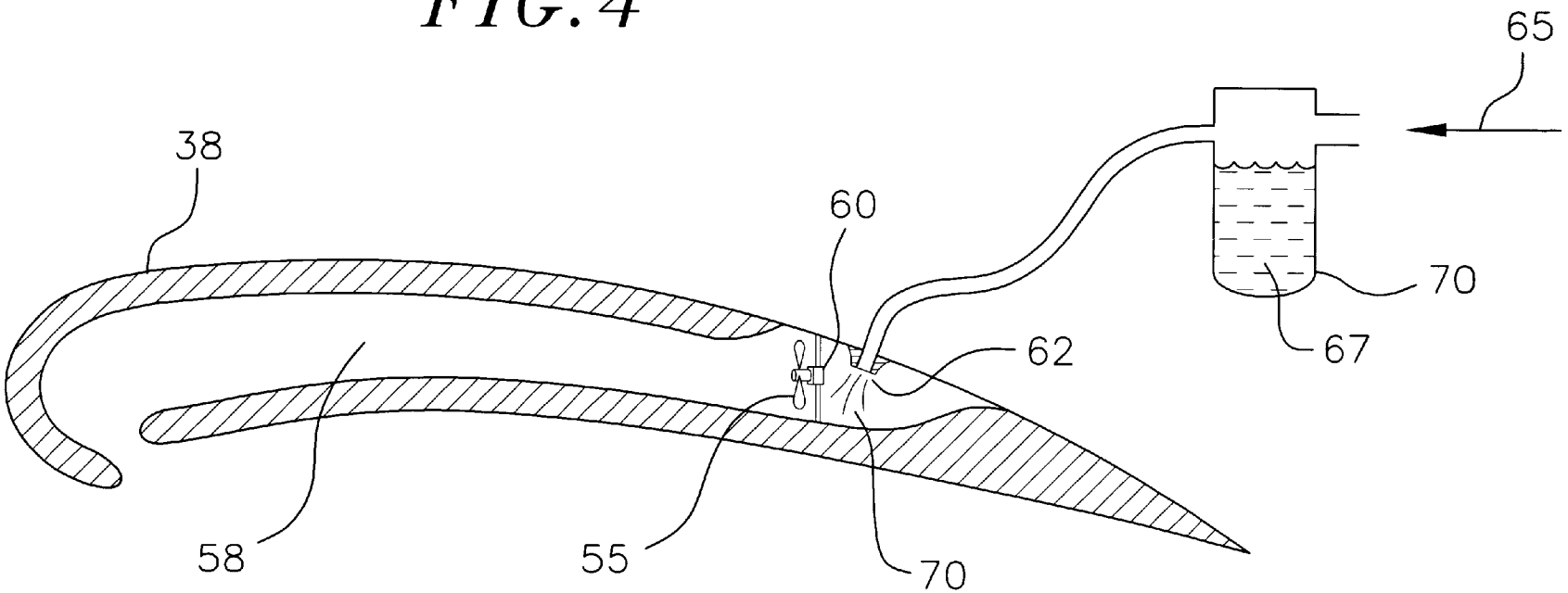
FIG. 4 is semi-schematic, side sectional view depicting a canopy that is deployable over a passenger seat in a preferred embodiment of the invention.

FIG. 4 is a semi-schematic sectional detail view of one of the canopies 38. As indicated therein, each canopy includes a fan 55 or another type of air blower positioned inside an air plenum 58 in the canopy. The fan, typically driven by an electric motor 60, is operable to move air over the passenger in the seat under the canopy.

Optionally, a nozzle 62 may be located in proximity to the fan 55. The nozzle in FIG. 4 is connected to a reservoir 70 located upstream of the nozzle. Compressed air is supplied through a compressed air inlet 65. The flowing air draws a scent material 67 from the scent reservoir 70 and delivers it through the nozzle 62 to the region of the fan. The scented air then moves through the air plenum 58, which directs it out of the canopy and downward over the passenger. Artificial scents may be injected thereby into the air stream moving over the passenger.

The apparatus described herein can be operated in combination to create an entertaining and highly immersive sensation of actual flight in the imaginations of the passengers. As the seats 18 are raised into position, the passenger 40 feels his feet leave the floor and his body being carried upward by the seat. As his seat 18 rises into position, the passenger 40 finds himself suspended with his feet dangling over a realistic or fanciful landscape projected in high resolution on the presentation screen. As the passenger feels himself soaring over the projected landscape, motion can be applied to his seat—by operating the seat driver 50 and by moving the seating assemblies 10 up and down with the drive assembly—to simulate wind currents or turbulence ranging from gentle to quite violent. At the same time, air is moving over the passenger's face, blown by the fan 55, perhaps with scents applied by the nozzle 62 corresponding to the projected artificial landscape. For example, a pine scent may be used in conjunction with pictures of a pine forest; an ocean scent may be used as the passenger with a corresponding nautical scene.

The reversible motors for the hanger support and for the individual seats, and the fan motor for the air stream, are each controlled by drive train controllers which are responsive to signals which determine their operation and, in the case of the drive train and seat motors, their direction and rate of motion. The signals necessary to control the motor operation are delivered by a programmed computer, in which the program is written to coordinate the motion experienced by the passenger, and the experience of rushing air or scent, with the sequence of images being displayed on the projection screen. Thus, the motion, air and scent experience can be coordinated with the visual experience to convey a particular adventure. If the visuals are changed, the computer can be reprogrammed to provide a new set of motion, air stream and scent experiences coordinated to the new sequence of images.

If the passenger 40 looks down, he sees the edge of the seat 18 and his own feet hanging down as he soars over the projection. Looking up, the projection extends realistically upwards to the point where the passenger's view is cut off by the forward edge of the canopy 38. The canopy itself, being shaped as an airfoil or wing, only adds to the illusion that the passenger is perched precariously in the sky, operating a hang glider or a similar flying machine.

At the simulation's conclusion, the seats 18 are lowered once again into the lowered position 12. Where a retracting floor 42 is present, the floor is once again raised into position in contact with the passengers' feet. The seatbelt or passenger restraint is then released so that the passengers can exit the ride to be replaced quickly and conveniently with a new set of passengers looking forward to the novel and exhilarating experience the invention provides. Seat belt control systems are used in conjunction with the controlling computer to ensure that the ride cannot commence until every passenger's belt is buckled before and during the ride and to effect controlled release at the deboarding portion of the ride.

Although the invention is usable with only a single seat and a solitary passenger, the preferred embodiment includes a number of seats arrayed in rows and suspended from a plurality of seating assemblies. Referring now to FIG. 5, each box 73 in the figure represents a single seat. The figure illustrates, in plan view, the positions of the seats both in their lowered positions 12, withdrawn from the screen and in position for passenger loading, and in their raised positions 15, suspended over the screen while the simulation is in action.

As FIG. 5 indicates, the preferred embodiment includes three passenger carriers positioned alongside one another, the positions of which are indicated by reference numerals 75, 78, and 80. Each passenger carrier includes three rows 83 of seats, each row having between seven and eleven individual seats.

Because the three carriers are angled slightly away from one another, aisles 85 are provided between the seat rows in the lowered positions 12 for loading and unloading passengers. Conversely, when the seat rows are in the raised position 15, the seats are clustered relatively tightly together so that more passengers can be boarded onto the apparatus to view the visual images on the presentation screen.

Although the invention has been described with respect to certain preformed embodiments, the inventions claimed are not limited to the described preferred embodiments but include such variations of the described inventions as would be evident to the worker of ordinary skill in this art.

What is claimed is:

1. An amusement apparatus for providing passengers with a viewing and riding experience, comprising;

a vertical support structure mounted on the ground;

a projection screen positioned in a spaced relation to an end of said support structure, said screen adapted to display images projected onto said screen;

at least two, generally upright, passenger seats arranged in longitudinally-spaced fore and aft relation to each other;

a seat hanger structure pivotally connected to each of said passenger seats adjacent its upper end, each of said seat supported for pivoting motion;

a guide structure, connected to said support structure in supporting engagement with said hanger structure, said guide structure supporting said hanger structure for motion relative to said support structure between;

a loading position to said support structure in which said seats are positioned at generally at the same horizontal level above the ground and are spaced apart by a sufficient distance to enable at least one passenger to enter and leave the space between said seats and become seated thereon; and a viewing position relative to said support structure in which said passenger seats are relatively positioned one above the other vertically and at a relatively closer longitudinal spacing than in said loading position with passengers facing towards said projection screen in viewing relation thereto; and a reversible driving system connected to said guide structure and said hanger structure which moves said hanger structure between said viewing position and said loading position.

2. An amusement apparatus as defined in claim 1 wherein said guide structure comprises:

a cam surface connected to said support structure;

a cam follower movably mounted on said cam surface for movement therealong between extreme positions;

said seat hanger structure being movably connected to and supported by said cam follower to position said passenger seats in said viewing position and in said loading position at said opposite extremes of movement of said cam follower.

3. An amusement apparatus as defined in claim 2 wherein:

said cam surface and said cam follower comprise a rail and a carriage riding along said rail, respectively; and said reversible drive system comprises a reversible motor drivingly connected to said carriage to selectively move it back and forth along said rail.

4. An amusement apparatus as defined in claim 3 wherein, said carriage is pivotally connected to said hanger structure adjacent one longitudinal end thereof;

and wherein a tether extends between and is connected to said support structure and said hanger structure adjacent an opposite end thereof, said tether positioned to cause said hanger structure to change its inclination, relative to the horizontal, to the extent necessary to effect the aforesaid relative positions of said seats to each other in said loading and viewing positions.

5. An amusement apparatus as defined in claim 4 wherein said tether is a rigid link pivotally connected at its opposite ends to said support structure and to said seat hanger.

6. An amusement apparatus as defined in claim 1 wherein said seats are configured such that, in said viewing position, a seated passenger in one of said seats has his lower line of sight to said screen intersected by his feet and by adjacent portions of said seat to prevent seeing below said projection screen and wherein each said seat further includes, adjunct its upper end, a canopy shaped to intersect the passenger's upper line of sight to said screen to prevent seeing above said projection screen.

7. An amusement apparatus as defined in claim 6 wherein each said canopy is a generally horizontal and extends from the associated one of said seats over the head of the passenger projecting forwardly thereof to limit his upward line of sight to the projection screen.

8. An amusement apparatus as defined in claim 7 further including at least one air outlet connected with each said seat facing toward the passenger's head, and a selectively controllable source of air in communication with said outlet which directs a stream of air from said outlet towards the passenger's face.

9. An amusement apparatus as defined in claim 8 further including:

a supply of scent in communication with said source of air thereby including scent in the stream of air directed to the passenger.

10. An amusement apparatus as defined in claim 1 further including:

an image projector positioned in a spaced relation to said projection screen for displaying a predetermined sequence of images on said projection screen;

a drive train controller connected to said drive train for controlling the operation and direction of movement thereof in response to a drive train signal; and a programmed computer operatively connected with said drive train controller for controlling movement of said hanger support in predetermined coordination with the sequence of displayed images.

11. An amusement apparatus as defined in claim 10 further including:

an air outlet connected to at least of said seats for directing an air stream against the passenger;

said computer being further programmed to coordinate the provision of an air stream with the sequence of images displayed.

12. An amusement apparatus as defined in claim 10 wherein said computer is further programmed to coordinate the movement of said passenger seats about their points of attachment to said hanger support with the sequence of images displayed.

13. An amusement apparatus as defined in claim 1 wherein each said seat has associated therewith a reversible seat inclination motor connected to said hanger support and to said seat adjacent said pivotal connection which can be selectively operated to vary the vertical inclination of said seat and thereby add one additional degree of motion to the passenger's experience.

14. A method of providing passengers in an amusement facility having at least two longitudinally aligned seats with a combined viewing and motion experience, comprising the steps of positioning the at least two longitudinally aligned seats, spaced apart in fore and aft relation, in a loading position at generally the same horizontal level at a sufficient spacing to enable a passenger to enter between the seats and become seated; and moving both seats in a longitudinal direction and concurrently elevating one of the seats vertically relative to the other until a viewing position is reached in which the longitudinal spacing of the seats is less than it was in the loading position but the upper and lower seats are vertically disposed, relative to each other, in approximately head to foot relation.

15. The method as described in claim 14 wherein the amusement facility further comprises a projection screen, and wherein the method further including the steps of:

projecting images on the projection screen in a predetermined sequence, and coordinating the movement of the seats to the sequence of images displayed in the projection screen to obtain a predetermined coordination of the movements experienced by the passenger with the images viewed by the passenger.

16. The method as defined in claim 15 further including the step of:

selectively directing a stream of air against each passenger.

17. The method as defined in claim 16 further including the step of:

incorporating scent into the stream of air directed against the passenger.

* * * * *